US009898030B2

(12) United States Patent
Lahiri

(10) Patent No.: US 9,898,030 B2
(45) Date of Patent: Feb. 20, 2018

(54) FRACTIONAL BANDGAP REFERENCE VOLTAGE GENERATOR

(71) Applicant: STMicroelectronics International N.V., Amsterdam (NL)

(72) Inventor: Abhirup Lahiri, Delhi (IN)

(73) Assignee: STMicroelectronics International N.V., Schiphol (NL)

( * ) Notice: Subject to any disclaimer, the term of this patent is extended or adjusted under 35 U.S.C. 154(b) by 35 days.

(21) Appl. No.: 15/207,732

(22) Filed: Jul. 12, 2016

(65) Prior Publication Data

US 2018/0017986 A1 Jan. 18, 2018

(51) Int. Cl.
*G05F 3/30* (2006.01)
*G05F 3/26* (2006.01)

(52) U.S. Cl.
CPC ..... *G05F 3/30* (2013.01); *G05F 3/262* (2013.01)

(58) Field of Classification Search
CPC ... G05F 3/30; G05F 3/262; G05F 3/02; G05F 3/24; G05F 3/26
See application file for complete search history.

(56) References Cited

U.S. PATENT DOCUMENTS 7,224,210 B2 5/2007 Garlapati et al.
2002/0093325 A1* 7/2002 Ju ..... G05F 3/30 323/316
2005/0231270 A1* 10/2005 Washburn ..... G05F 3/30 327/539
2009/0110027 A1* 4/2009 Chellappa ..... G01K 7/01 374/178
2009/0121699 A1* 5/2009 Park ..... G05F 3/30 323/313
2013/0038317 A1* 2/2013 Marinca ..... G05F 3/30 323/313

OTHER PUBLICATIONS

Fayomi, Christian Jesus B. et al: "Sub 1 V CMOS Bandgap Reference Design Techniques: A Survey," Analog Integr Circ Sig Process (2010) 62:141-157.
Mok, Philip K.T. et al: "Design Considerations of Recent Advanced Low-Voltage Low-Temperature-Coefficient CMOS Bandgap Voltage Reference," IEEE 2004 Custom Integrated Circuits Conference, pp. 635-642.

* cited by examiner

*Primary Examiner* — Adolf Berhane
*Assistant Examiner* — Bart Iliya
(74) *Attorney, Agent, or Firm* — Gardere Wynne Sewell LLP

(57) ABSTRACT

A reference voltage generator circuit includes a circuit that generates a complementary to absolute temperature (CTAT) voltage and a proportional to absolute temperature (PTAT) current. An output current circuit generates, from the PTAT current, a sink PTAT current sunk from a first node and a source PTAT current sourced to a second node, wherein the sink and source PTAT currents are equal. A resistor is directly connected between the first node and the second node. A divider circuit divides the CTAT voltage to generate a divided CTAT voltage applied to the first node. A voltage at the second node is a fractional bandgap reference voltage equal to a sum of the divided CTAT voltage and a voltage drop across the resistor that is proportional to a resistor current equal to the sink and source PTAT currents.

15 Claims, 3 Drawing Sheets

FRACTIONAL BANDGAP REFERENCE VOLTAGE GENERATOR

TECHNICAL FIELD

The present invention relates to a circuit for generating a reference voltage in an integrated circuit device and, in particular, to a circuit for generating a reference voltage that is less than the bandgap voltage.

BACKGROUND

Bandgap reference voltage generator circuits are well known in the art. Such circuits are configured to generate a reference voltage that is approximately equal to the bandgap voltage (Vbg) of silicon (i.e., 1.205 Volts at zero degrees Kelvin). Generating such a voltage from a power supply voltage in excess of 1.8 Volts, for example, is of no concern. However, now integrated circuit devices are provided with supply voltages well below 1.8 Volts. Indeed, some integrated circuit devices or circuit portions within the integrated circuit device may be powered with an input supply voltage as low as 0.5 Volts. Operating analog circuitry, such as bandgap reference voltage generator circuits, at such low input supply voltage levels is a challenge.

It is further recognized in the art that the reference voltage needed may be less than the bandgap voltage (i.e., a sub-bandgap voltage) and in particular may be an integer fraction of the bandgap voltage. For example, for analog circuits operating at low supply voltages, the reference voltage must be lower than the supply voltage. An analog circuit operating with a low on-chip supply voltage of 1.0 Volts, for example, may require a reference voltage of 0.6 Volts, which can be obtained as an integer fraction (1.205/2) of the bandgap voltage.

An example of a fractional bandgap reference voltage generator circuit is the so-called Banba bandgap reference voltage generator circuit 10 as shown in FIG. 1. See also, Banba, et al. "A CMOS Bandgap Reference Circuit with Sub-1-V Operation," IEEE Journal of Solid State Circuits, vol. 34, pp. 670-674, May 1999. The emitter area of transistor Q1 is n times larger than the emitter area of transistor Q2. In a common configuration, n=8. Both transistor Q1 and transistor Q2 are configured as diode-connected devices. The operational amplifier drives the gates of transistors M1 and M2 to force the voltage at the inverting input of the operational amplifier to equal the voltage at the non-inverting input of the operational amplifier. With these voltages being equal, the current I2 in the resistor R2 is proportional to the base to emitter voltage (Vbe) of transistor Q2 (i.e., I2=Vbe/R2). The current I1 flowing through each of the transistors Q1 and Q2 is given by I1=$V_T$ ln(n)/R1. As a result, the current Im flowing through each of the transistors M1 and M2 is Im=($V_T$ ln(n)/R1)+(Vbe/R2). The first component of the current Im is proportional to absolute temperature (PTAT) and the second component is complementary to absolute temperature (CTAT). Thus, the current Im can be made temperature independent (i.e., having an at or near zero temperature coefficient). This current Im is mirrored using a current mirror circuit formed by transistor M3 to generate a temperature independent output current Io. The output current Io flows through resistor R3 to develop the output reference voltage Vref (where Vref=(R3/R2)($V_T$(R2/R1)ln(n)+Vbe.) If R3=R2/N, then a fractional bandgap reference voltage Vref=Vbg/N is generated. More specifically, the ratio of resistances for R2/R1 is chosen so that the slope of the PTAT voltage with temperature cancels the slope of the CTAT voltage Vbe with temperature. Generally, R2/R1 is approximately equal to 9-10 if n=8 in order to balance the slopes and obtain a compensated voltage. Mathematically, this may be represented as: R2*log(n)/R1=−(dVbe/dT)/(d$V_T$/dT) where d/dT is the derivative with respect to temperature.

For low power applications, it is important for the currents in the reference voltage generator circuit 10 to be small. This necessitates the use of large resistance value resistors which occupy a correspondingly large amount of integrated circuit chip area. There is accordingly a need in the art for a fractional bandgap reference voltage generator circuit that supports low power supply operation with low current (i.e., low power operation) and a reduced occupation of integrated circuit area.

SUMMARY

In an embodiment, a reference voltage generator circuit comprises: a current generator circuit configured to generate a current that is proportional to absolute temperature (PTAT) and a voltage that is complementary to absolute temperature (CTAT); a divider circuit configured to divide the CTAT voltage to generate a divided CTAT voltage at a first node; a resistor connected between a second node and the first node; and an output current circuit configured to generate, from the PTAT current, a source PTAT current and a sink PTAT current, wherein the source and sink PTAT currents are equal, and wherein said source PTAT current is applied to the second node and said sink PTAT current is applied to the first node; wherein a voltage at the second node is a fractional bandgap reference voltage equal to a sum of the divided CTAT voltage and a voltage drop across the resistor that is proportional to said PTAT current.

In an embodiment, a reference voltage generator circuit comprises: a circuit configured to generate a complementary to absolute temperature (CTAT) voltage and a proportional to absolute temperature (PTAT) current; an output current circuit configured to generate, from the PTAT current, a sink PTAT current sunk from a first node and a source PTAT current sourced to a second node, wherein the sink and source PTAT currents are equal; a resistor directly connected between the first node and the second node; and a divider circuit configured to divide the CTAT voltage to generate a divided CTAT voltage applied to the first node; wherein a voltage at the second node is a sub-bandgap reference voltage equal to a sum of the divided CTAT voltage and a voltage drop across the resistor that is proportional to a resistor current equal to said sink and source PTAT currents.

In an embodiment, a system comprises: an input configured to receive an input supply voltage that is less than a bandgap voltage; a clock circuit powered from said input supply voltage and configured to generate a clock signal; a charge pump circuit configured to receive the input supply voltage and the clock signal and generate a low supply voltage that less than the bandgap voltage; and a reference voltage generator circuit powered from the low supply voltage and configured to generate a reference voltage in excess of the input supply voltage and less than the low supply voltage. The reference voltage generator circuit comprises: a circuit configured to generate a complementary to absolute temperature (CTAT) voltage and a proportional to absolute temperature (PTAT) current; an output current circuit configured to generate, from the PTAT current, a sink PTAT current sunk from a first node and a source PTAT current sourced to a second node, wherein the sink and source PTAT currents are equal; a resistor directly connected between the first node and the second node; and a divider circuit configured to divide the CTAT voltage to generate a divided CTAT voltage applied to the first node; wherein the reference voltage is output at the second node and is equal to a sum of the divided CTAT voltage and a voltage drop across the resistor that is proportional to the PTAT current.

BRIEF DESCRIPTION OF THE DRAWINGS

For a better understanding of the embodiments, reference will now be made by way of example only to the accompanying figures in which.

DETAILED DESCRIPTION OF THE DRAWINGS

Figure 2:
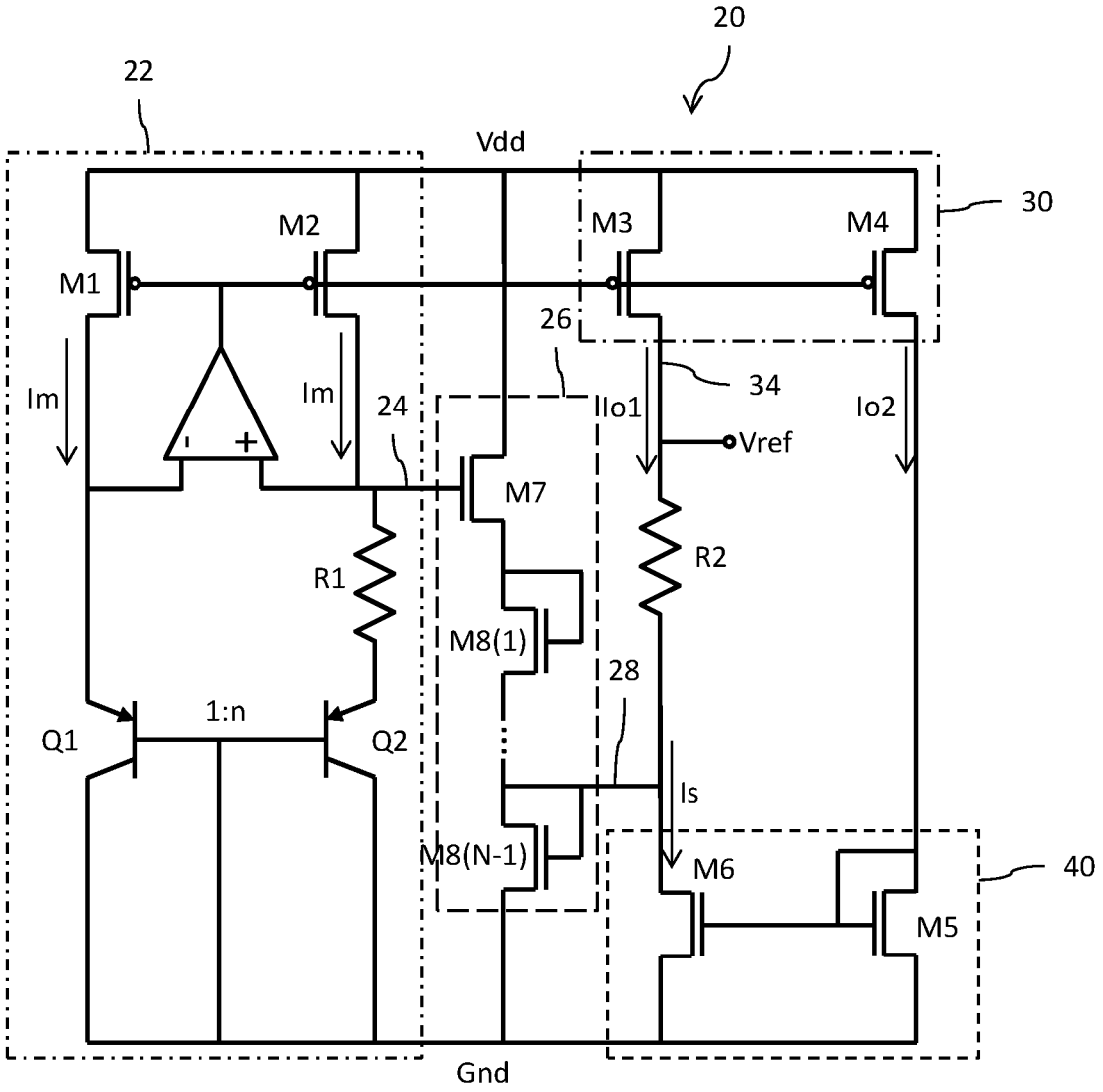
FIG. 2-3 are circuit diagrams of a low power low area fractional bandgap reference voltage generator circuit.

Reference is now made to FIG. 2 showing a circuit diagram of a low power low area fractional bandgap reference voltage generator circuit 20.

The circuit 20 includes a proportional to absolute temperature (PTAT) current generator circuit 22. The circuit 22 includes two bipolar transistors Q1 and Q2. The emitter area of transistor Q2 is n times larger than the emitter area of transistor Q1. In an implementation, n=4 or n=8, for example, where relatively smaller values of n are preferred. Both transistor Q1 and transistor Q2 are configured as diode-connected devices with their base terminals and collector terminals coupled to ground (Gnd). An operational amplifier includes an inverting input (−) connected to the emitter terminal of transistor Q1 and a non-inverting input (+) coupled to the emitter terminal of transistor Q2 through a resistor R1. A pair of p-channel MOSFET devices (transistors M1 and M2) are connected to each other with common gate terminals and further having their source terminals connected to a supply voltage (Vdd) node. The drain terminal of transistor M1 is connected to the emitter terminal of transistor Q1 at the inverting input of the operational amplifier. The drain terminal of transistor M2 is connected to resistor R1 at the non-inverting input of the operational amplifier. An output of the operational amplifier drives the gate terminals of transistors M1 and M2 to force the voltage at the inverting input of the operational amplifier to equal the voltage at the non-inverting input of the operational amplifier. In this condition, those equal input voltages are further equal to the base to emitter voltage (Vbe) of the transistor Q1, and thus the Vbe voltage is present at the voltage output from the circuit 22 at node 24. The current flowing through resistor R1 is given by $V_T \ln(n)/R1$ and is equal to the current Im flowing through the transistor M2. This current Im is a PTAT current. The voltage at node 24 (V24), however, is derived from the Vbe voltage and is thus complementary to absolute temperature (CTAT).

Figure 3:
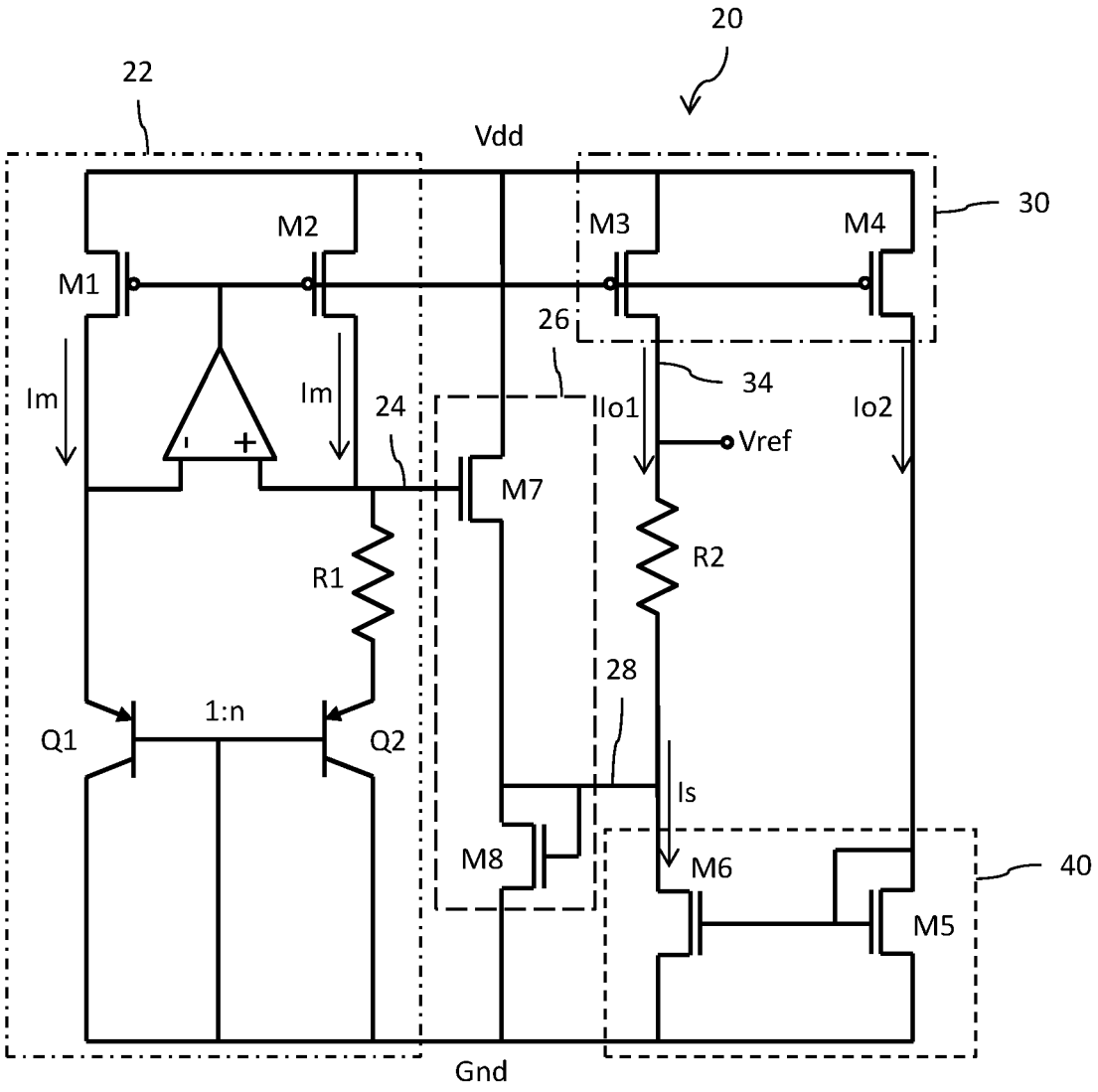

The circuit 20 further includes a voltage divider circuit 26 configured to divide the voltage at node 24 by an integer value N. The circuit 26 includes an input n-channel MOSFET device (transistor M7) coupled in series with N−1 diode-connected n-channel MOSFET devices (transistors M8(1)-M8(N−1)). The transistors M7-M8(N−1) are equally sized and have their source-drain paths connected in series with each other between the supply node and ground. Each diode-connected transistor has its gate terminal coupled to its drain terminal. The voltage divider circuit 26 functions to divide the voltage at node 24 (V24=Vbe) by N and output a divided voltage at node 26 (V26=V24/N=Vbe/N). As an example, the voltage divider circuit 26 may be configured to divide by N=2 by having input transistor M7 and only one diode-connected transistor M8 connected in series (see, FIG. 3). A divide by N=3 implementation would utilize input transistor M7 and two diode connected transistors M8(1) and M8(2) connected in series. Because the input voltage at node 24 (V24=Vbe) is CTAT, the output voltage at node 26 (V26=Vbe/N) is also CTAT.

An output current circuit is also included. The PTAT current output from the PTAT current generator circuit 22 is provided through a current mirror circuit 30 of the output current circuit that includes a first p-channel MOSFET device (transistor M3) having a source terminal coupled to the voltage supply node and a gate terminal coupled to the gate terminals of the transistors M1 and M2 of the PTAT current generator circuit 22. The transistor M3 mirrors the current Im to source, from its drain terminal, a first output current Io1.

The current mirror circuit 30 further includes a second p-channel MOSFET device (transistor M4) having a source terminal coupled to the voltage supply node and a gate terminal coupled to the gate terminals of the transistors M1 and M2 of the PTAT current generator circuit 22. The transistor M4 also mirrors the current Im to source, from its drain terminal, a second output current Io2.

The transistors M3 and M4 are preferably matching devices, and thus the output currents Io1 and Io2 are equal to each other (Io1=Io2).

The output current circuit of the circuit 20 further includes a current mirror circuit 40 formed by a first n-channel MOSFET device (transistor M5) and a second n-channel MOSFET device (transistor M6). The transistor M5 has a source terminal coupled to ground and a gate terminal coupled to its drain terminal and further coupled to the drain terminal of transistor M4. The transistor M6 has a source terminal coupled to ground and a gate terminal coupled to the gate terminal of transistor M5. The input of the current mirror circuit 40 at the drain of transistor M5 receives the second output current Io2 and the output of the current mirror circuit 40 at the drain of transistor M6 generates a sink current Is. The transistors M5 and M6 are preferably matching devices, and thus the sink current Is is equal to the received output current Io2 (Io2=Is=Io1=Im). The drain terminal of transistor M6 in connected to node 26 at the output of the voltage divider circuit 26.

A resistor R2 has a first terminal connected to the drain terminal of transistor M3 at node 34 and a second terminal connected to node 26 (at the common outputs of the voltage divider circuit 26 and current mirror circuit 40). The current mirror circuits 30 and 40 operate to ensure that a same magnitude current is applied to both terminals of the resistor R2 applied (i.e., a source current that is output current Io1 is applied to the first terminal of resistor R2 at node 34 and the sink current Is is applied to the second terminal of resistor R2 at node 24, where Io1=Is=Im). With this operation, the PTAT current Im flows through the resistor R2 to generate a PTAT voltage drop across resistor R2 that is equal to R2*Im. The equal source and sink currents, Io1 and Is, respectively, further ensures that the divided voltage at node 26 (V26) remains a fraction of the Vbe voltage as set by the operation of the divider circuit 26.

An output reference voltage Vref is thus generated at the drain of transistor M3 at node 34. This output reference voltage Vref is equal to the sum of the voltage drop across resistor R2 and the divided voltage at node 26 (V26); Vref=Im*R2+V26. Because the current Im is PTAT, the voltage drop across resistor R2 is also PTAT. However, the divided voltage at node 26 (V26) is CTAT. Thus, the output reference voltage Vref can be made temperature independent (i.e., having an at or near zero temperature coefficient) and is preferably a sub-bandgap (i.e., <Vbg) voltage. With proper selection of R1 and R2, Vref=Vbg/N. More specifically, the ratio of resistances for R2/R1 is chosen so that the slope of the PTAT voltage across resistor R2 with temperature cancels the slope of the CTAT voltage of Vbe/N with temperature to obtain the fractional bandgap voltage at node 34. Mathematically, this may be represented as: R2*log(n)/R1=−(dVbe/dT)/(N*$dV_T$/dT) where d/dT is the derivative with respect to temperature.

With Vref=(R2*Io1)+V26, where Io1=Im;

V26=V24/N=Vbe/N

So, Vref=(R2*Im)+Vbe/N.

Im=$V_T$ ln(n)/R1

So, Vref=((R2/R1)$V_T$ ln(n))+Vbe/N.

With proper selection of R1 and R2 relative to N as discussed above, Vref=Vbg/N.

Figure 1:
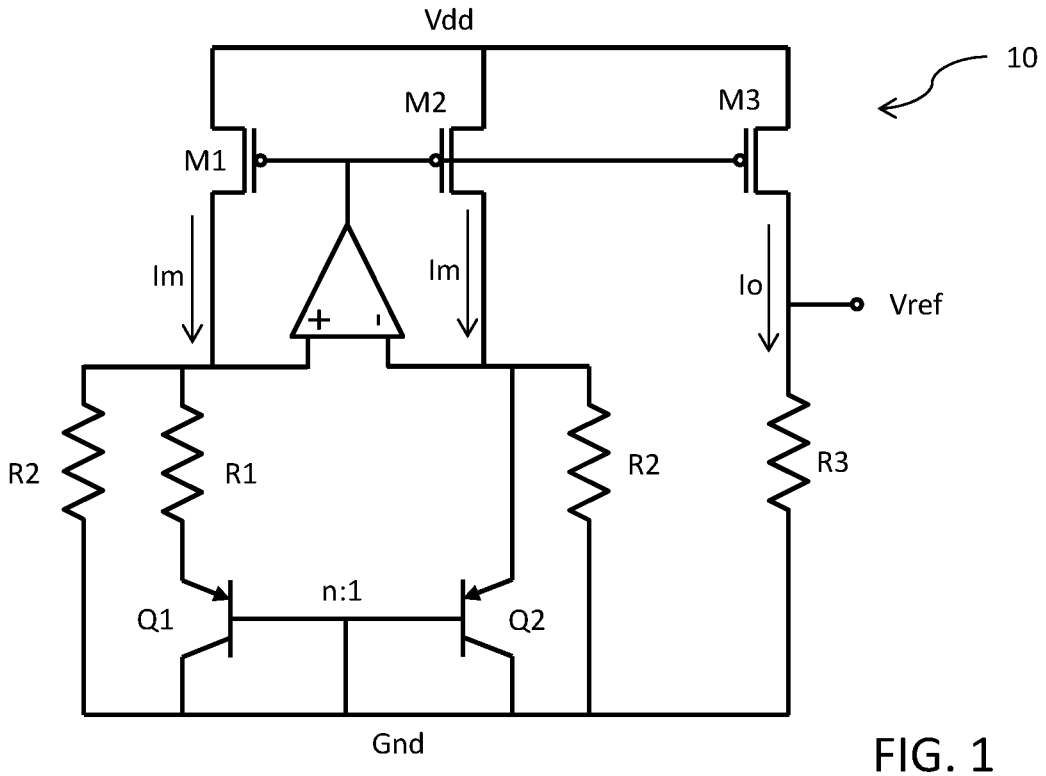
FIG. 1 (Prior Art)
FIG. 1 is a circuit diagram of a prior art fractional bandgap reference voltage generator circuit.

It will be noted that the circuit 20 of FIG. 2 includes only two resistors and thus will occupy a smaller integrated circuit area than the circuit 10 of FIG. 1.

Figure 4:
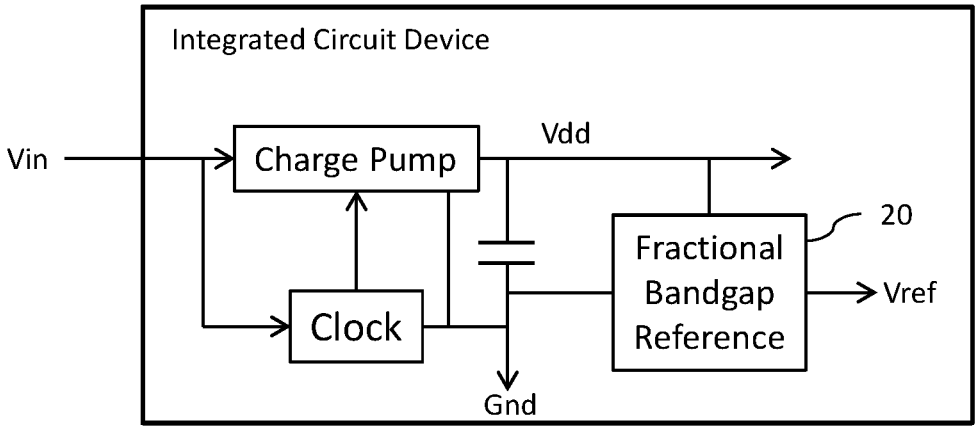
FIG. 4 is a block diagram for an integrated circuit device including the low power low area fractional bandgap reference voltage generator circuit of FIG. 2 or FIG. 3.

In order to ensure proper headroom for operation of the current mirror circuitry in the circuit 20, the supply voltage Vdd should preferably equal or exceed 1.0 Volts. In some integrated circuit devices and systems, very low input supply voltages (Vin) on the order of 0.5 Volts are applied to the integrated circuit chip. In such cases, the integrated circuit chip may include a voltage boosting circuit, such as a charge pump circuit, to receive the very low input supply voltage Vin and generate the supply voltage Vdd for the circuit 20 in response to a clock signal generated by a clock circuit. Such a configuration is shown in FIG. 4.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. A reference voltage generator circuit, comprising:

a current generator circuit configured to generate a current that is proportional to absolute temperature (PTAT) and a voltage that is complementary to absolute temperature (CTAT);

a divider circuit configured to divide the CTAT voltage to generate a divided CTAT voltage at a first node;

a resistor connected between a second node and the first node; and an output current circuit configured to generate, from the PTAT current, a source PTAT current and a sink PTAT current, wherein the source and sink PTAT currents are equal, and wherein said source PTAT current is applied to the second node and said sink PTAT current is applied to the first node;

wherein a voltage at the second node is a fractional bandgap reference voltage equal to a sum of the divided CTAT voltage and a voltage drop across the resistor that is proportional to said PTAT current.

2. The reference voltage generator circuit of claim 1, wherein said divider circuit divides the CTAT voltage by an integer value N, and wherein said fractional bandgap reference voltage is equal to a bandgap voltage divided by N.

3. The reference voltage generator circuit of claim 2, wherein said resistor has a resistance value set as a function of the integer value N.

4. The reference voltage generator circuit of claim 3, wherein said current generator circuit includes a first resistor having a first resistance value and the PTAT current has a magnitude set as a function of the first resistance value, and wherein said resistor has a second resistance value and a PTAT voltage drop occurs across said resistor to be added to the divided CTAT voltage forming the fractional bandgap reference voltage.

5. The reference voltage generator circuit of claim 1, wherein the output current circuit comprises:

a first current mirror circuit configured to mirror the PTAT current to generate said source PTAT current and an output current; and a second current mirror circuit configured to mirror the output current to generate said sink PTAT current.

6. The reference voltage generator circuit of claim 1, wherein the divider circuit comprises:

an input transistor having a gate terminal coupled to receive the CTAT voltage; and a diode-connected transistor having a source-drain path coupled in series with a source-drain path of the input transistor, wherein said divided CTAT voltage is generated at a gate terminal of the diode-connected transistor.

7. The reference voltage generator circuit of claim 6, wherein said divider circuit further comprises at least one further diode-connected transistor having a source-drain path coupled in series between the input transistor and said diode-connected transistor.

8. The reference voltage generator circuit of claim 7, wherein said divider circuit divides the CTAT voltage by an integer value N, and wherein N equals one more than a number of further diode-connected transistors coupled in series between the input transistor and said diode-connected transistor.

9. A reference voltage generator circuit, comprising:

a circuit configured to generate a complementary to absolute temperature (CTAT) voltage and a proportional to absolute temperature (PTAT) current;

an output current circuit configured to generate, from the PTAT current, a sink PTAT current sunk from a first node and a source PTAT current sourced to a second node, wherein the sink and source PTAT currents are equal;

a resistor directly connected between the first node and the second node; and a divider circuit configured to divide the CTAT voltage to generate a divided CTAT voltage applied to the first node;

wherein a voltage at the second node is a sub-bandgap reference voltage equal to a sum of the divided CTAT voltage and a voltage drop across the resistor that is proportional to a resistor current equal to said sink and source PTAT currents.

10. The reference voltage generator circuit of claim 9, wherein said divider circuit divides the CTAT voltage by an integer value N, and wherein said sub-bandgap reference voltage is equal to a bandgap voltage divided by N.

11. The reference voltage generator circuit of claim 10, wherein said resistor has a resistance value set as a function of the integer value N.

12. The reference voltage generator circuit of claim 10, wherein said circuit includes a first resistor having a first resistance value coupled in series with a first bipolar transistor, and wherein the CTAT voltage is a base to emitter voltage of a second bipolar transistor base coupled to the first bipolar transistor, and wherein said resistor has a second resistance value and a PTAT voltage drop occurs across said resistor to be added to the divided CTAT voltage forming the sub-bandgap reference voltage.

13. The reference voltage generator circuit of claim 9, wherein the output current circuit comprises:

a first current mirror circuit configured to mirror the PTAT current to generate said source PTAT current and an output current; and a second current mirror circuit configured to mirror the output current to generate said sink PTAT current.

14. The reference voltage generator circuit of claim 9, wherein the divider circuit comprises:

an input transistor having a gate terminal coupled to receive the CTAT voltage; and a diode-connected transistor having a source-drain path coupled in series with a source-drain path of the input transistor, wherein said divided CTAT voltage is generated at a gate terminal of the diode-connected transistor.

15. A system, comprising:

an input configured to receive an input supply voltage that is less than a bandgap voltage;

a clock circuit powered from said input supply voltage and configured to generate a clock signal;

a charge pump circuit configured to receive the input supply voltage and the clock signal and generate a low supply voltage that less than the bandgap voltage; and a reference voltage generator circuit powered from the low supply voltage and configured to generate a reference voltage in excess of the input supply voltage and less than the low supply voltage, said reference voltage generator circuit comprising:

a circuit configured to generate a complementary to absolute temperature (CTAT) voltage and a proportional to absolute temperature (PTAT) current;

an output current circuit configured to generate, from the PTAT current, a sink PTAT current sunk from a first node and a source PTAT current sourced to a second node, wherein the sink and source PTAT currents are equal;

a resistor directly connected between the first node and the second node; and a divider circuit configured to divide the CTAT voltage to generate a divided CTAT voltage applied to the first node;

wherein the reference voltage is output at the second node and is equal to a sum of the divided CTAT voltage and a voltage drop across the resistor that is proportional to the PTAT current.

* * * * *